US010284948B2

(12) United States Patent
Petley et al.

(10) Patent No.: US 10,284,948 B2
(45) Date of Patent: May 7, 2019

(54) ACTIVE NOISE CONTROL FOR VEHICLES

(71) Applicant: JAGUAR LAND ROVER LIMITED, Warwickshire (GB)

(72) Inventors: Dean Petley, Coventry (GB); Simon Fletcher, Coventry (GB)

(73) Assignee: JAGUAR LAND ROVER LIMITED, Whitley, Coventry (GB)

( * ) Notice: Subject to any disclaimer, the term of this patent is extended or adjusted under 35 U.S.C. 154(b) by 0 days.

(21) Appl. No.: 15/550,809

(22) PCT Filed: Dec. 17, 2015

(86) PCT No.: PCT/EP2015/080175

§ 371 (c)(1),
(2) Date: Aug. 14, 2017

(87) PCT Pub. No.: WO2016/134802

PCT Pub. Date: Sep. 1, 2016

(65) Prior Publication Data

US 2018/0048957 A1 Feb. 15, 2018

(30) Foreign Application Priority Data

Feb. 25, 2015 (GB) ..... 1503130.5

(51) Int. Cl.
*H04R 3/00* (2006.01)
*H04R 29/00* (2006.01)
(Continued)

(52) U.S. Cl.
CPC ..... *H04R 3/007* (2013.01); *G10K 11/00* (2013.01); *G10K 11/178* (2013.01); *H04R 1/028* (2013.01);
(Continued)

(58) Field of Classification Search
CPC ..... H04R 3/00; H04R 3/007; H04R 29/00; H04R 1/028; H04R 2499/13; G10K 11/00;
(Continued)

(56) References Cited

U.S. PATENT DOCUMENTS 5,222,148 A * 6/1993 Yuan ..... F01N 1/065 381/71.9
5,386,472 A * 1/1995 Pfaff ..... F01N 1/065 381/71.12
(Continued)

FOREIGN PATENT DOCUMENTS

DE 19941126 A1 4/2001
DE 102013215094 A1 2/2015
(Continued)

OTHER PUBLICATIONS

Combined Search and Examination Report under Sections 17 and 18(3) for Application No. GB1503130.5 dated Aug. 12, 2015.
(Continued)

*Primary Examiner* — Thang V Tran
(74) *Attorney, Agent, or Firm* — Carlson, Gaskey & Olds

(57) ABSTRACT

Aspects of the present invention relate to an active noise system (4), a vehicle (1) with an active noise system (4), a method for controlling an active noise system (4), a computer program for controlling an active noise system (4) and an active noise controller (40). The wading detection system (3) includes sensors (30, 31, 32, 33) for detecting a wading depth and a wading detection controller (34). The active noise system (4) includes speakers (41, 42) for modifying the exhaust noise emitted from the vehicle (1). The wading detection controller (34) is operable to detect or anticipate a predetermined wading depth ($W_1$, $W_2$) at which the speakers (41, 42) will come into contact with the water. The active noise controller (40) is configured to deactivate the speakers
(Continued)

(41, 42) when the predetermined wading depth ($W_1$, $W_2$) is detected or anticipated by the wading detection controller (34).

19 Claims, 2 Drawing Sheets

(51) Int. Cl.
*G10K 11/00* (2006.01)
*G10K 11/178* (2006.01)
*H04R 1/02* (2006.01)

(52) U.S. Cl.
CPC ..... *G10K 2210/1282* (2013.01); *G10K 2210/3046* (2013.01); *H04R 2499/13* (2013.01)

(58) Field of Classification Search
CPC ..... G10K 11/178; G10K 2210/1282; G10K 2210/12822; G10K 2210/3046
See application file for complete search history.

(56) References Cited

U.S. PATENT DOCUMENTS 9,026,310 B2 * 5/2015 Tran ..... B60G 17/0165 701/37
9,707,964 B2 * 7/2017 Di Miro ..... B60W 50/0097
2005/0045134 A1 * 3/2005 Amanuma ..... B60K 6/44 123/179.4
2010/0112387 A1 * 5/2010 Nagasawa ..... B60L 3/00 429/413
2011/0202265 A1 * 8/2011 Norden ..... F01N 11/002 701/113
2012/0257763 A1 * 10/2012 Bowden ..... G10K 11/178 381/71.4
2013/0336090 A1 * 12/2013 Tran ..... B60G 17/0165 367/13
2014/0156126 A1 * 6/2014 Tran ..... B60G 17/0165 701/22
2014/0293056 A1 * 10/2014 Popham ..... G01F 23/0061 348/148
2014/0293746 A1 * 10/2014 Tran ..... G01F 23/00 367/93
2015/0046032 A1 * 2/2015 Clarke ..... B60G 17/0165 701/37
2016/0090885 A1 * 3/2016 Holsch ..... F01N 1/065 701/102
2017/0234180 A1 * 8/2017 Petley ..... F01N 1/065 381/71.1
2017/0326977 A1 * 11/2017 Burt ..... B60K 23/0808

FOREIGN PATENT DOCUMENTS

GB 2376929 A 12/2002
GB 2489109 A 9/2012

OTHER PUBLICATIONS

International Search Report and Written Opinion of the International Searching Authority for International application No. PCT/EP2015/080175 dated Mar. 10, 2016.

* cited by examiner

ACTIVE NOISE CONTROL FOR VEHICLES

TECHNICAL FIELD

The present disclosure relates to active noise control for vehicles. Aspects of the invention relate to a system, to a vehicle, to a method, to a computer program element, to a computer readable medium and to a controller.

BACKGROUND

It is known to provide active noise systems in motor vehicles, particularly hybrid electric vehicles, in which one or more speaker units are fitted. These speakers, in conjunction with various control means and methods, are used to provide noise waveforms, usually related to the 'natural' noise generated by the exhaust system. These noise waveforms may be used to 'cancel out' or minimise or suppress native exhaust notes, or may be used to enhance them. For example, external speaker systems are common in hybrid electric vehicles to generate vehicular noise when such vehicles are travelling under electric power in order to provide warning to pedestrians. Other arrangements involve enhancing the noise produced by the exhaust system where a sport mode is enabled and it is desirable to produce a particular noise profile. Yet further arrangements are configured to suppress exhaust noise in order to provide a quiet 'luxury' driving experience for drivers or passengers.

Active noise systems suffer if submerged in water. Such submersion may result from unexpected road flooding, in the case of a normal road vehicle, or as a result of intentional driving in the case of an 'off-road' or 4×4-type vehicle. In particular, when submerged the speakers suffer from attempting to work in the denser medium (water rather than air), which may result in physical damage as they attempt to vibrate the 'working' parts against the greater pressure of the surrounding medium.

Various methods have been suggested for protecting speaker systems against such damage, including physical protective methods such as waterproofing, pressure compensating surge tanks, speaker diaphragm stabilisers, and actuator snorkels. However, these all have implications for design and development, tooling, and piece price cost, as well as system complexity and packaging impact.

It is an aim of the invention to provide a solution that prevents damage to components whilst avoiding, or at least mitigating, the disadvantages of other prior art solutions.

SUMMARY OF THE INVENTION

Aspects of the invention relate to a system, to a vehicle, to a method, to a computer program element, to a computer readable medium and to a controller as claimed in the appended claims.

According to an aspect of the invention, there is provided an active noise system for use in a vehicle having a wading detection means. The system may comprise audible output means, an input means for receiving one or more signals from the wading detection means and/or a processor operatively connected to the audible output means and/or to the input means. The system or processor may be configured to deactivate, in use, the audible output means on or after a wading condition, e.g. a predetermined wading depth, is detected or anticipated by the wading detection means.

Thus, embodiments of the invention provide a simple yet effective means of preventing damage to the audible output means. For the avoidance of doubt, the term 'deactivate' as used herein includes the prevention of operation.

The system may comprise an input means or input, e.g. for receiving one or more signals from a wading detection means, which input means may be operatively connected to the processor. In embodiments, the input means may be configured or adapted to connect to or with the wading detection means of a vehicle. In embodiments, the system comprises the wading detection means, which may be operatively connected to the input means.

The system or processor may be configured to reactivate, in use, the audible output means, e.g. on or after detection or anticipation of the end of a wading condition, for example by the wading detection means. In embodiments, the system or processor is configured to reactivate, in use, the audible output means after a predetermined period of time, e.g. after detection of the end of a wading condition, for example by the wading detection means.

The audible output means may comprise an audible output. The system or audible output means may comprise one or more acoustic output devices. In embodiments, the system or audible output means comprises two or more, e.g. a plurality of, acoustic output devices. The system or processor may be configured to deactivate, in use, each acoustic output device independently, e.g. on or after detection or anticipation of a respective wading depth. The acoustic output devices may include one or more electro acoustic transducers and/or amplifiers and/or sirens and/or speakers and/or loudspeakers. The acoustic output devices may be comprised in, on or connected, in use, to an exhaust system of the vehicle. The acoustic output devices may be mounted to the underside of the vehicle, for example in a suitable position, e.g. where there is sufficient space. The audible output means may act as a muffler and/or may be housed in an exhaust muffler.

The system or processor may be configured to deactivate, in use, a first acoustic output device, e.g. on or after detection or anticipation of a first wading depth, for example by the wading detection means. Additionally or alternatively, the system or processor may be configured to deactivate, in use, a second acoustic output device, e.g. on or after detection or anticipation of a second wading depth, for example by the wading detection means. Additionally or alternatively, the system or processor may be configured to deactivate, in use, each acoustic output device, e.g. on or after detection or anticipation of a respective wading depth, for example by the wading detection means.

In embodiments, two or more or each of the respective wading depths, e.g. the first and second wading depths, are different. In embodiments, two or more or each of the respective wading depths, e.g. the first and second wading depths, are the same.

In embodiments, the system or processor is configured to reactivate, in use, the first acoustic output device, e.g. on or after detection of a depth less than the first wading depth, for example by the wading detection means. Additionally or alternatively, the system or processor may be configured to reactivate the second acoustic output device, e.g. on or after detection of a depth less than the second wading depth, for example by the wading detection means. Additionally or alternatively, the system or processor may be configured to reactivate each acoustic output device independently, e.g. on or after detection of a depth less than the respective wading depth, for example by the wading detection means.

The system may comprise a wading detection means, which may be operatively connected to the input means. The wading detection means, whether or not incorporated into the system, may comprise one or more sensors, which may be mounted or mountable to a vehicle, for example at one or more, e.g. two or more or a plurality of, locations. One or more of the sensors may comprise a sensor responsive to contact with water.

One or more of the sensors may comprise a sensor operable to sense water, or the depth or the position of a surface of water, by conduction, e.g. a conductive sensor, or by transmission and/or reflection of a waveform. Additionally or alternatively, one or more of the sensors may comprise a camera detector or a computer vision apparatus. Additionally or alternatively, one or more of the sensors may comprise a geospatial positioning means and/or a communication means, e.g. for receiving information regarding water levels and/or precipitation levels associated with one or more geospatial locations. The geospatial positioning means may comprise a geospatial positioner or geospatial positioning system, for example a global positioning system. The geospatial positioning means may comprise one or more sensors operable to determine a location at least partially from or based on one or more satellites. In such embodiments, the wading detection means may comprise one or more algorithms operable to anticipate a wading condition based at least in part on information received by the communication means.

The wading detection means may comprise a wading detector or a wading detection system. The wading detection means may be operable to determine a wading depth. In embodiments, a wading condition may correspond to a detected or anticipated wading depth that exceeds a predetermined wading depth. Additionally or alternatively, the detection of the end of a wading condition may correspond to a detected wading depth dropping below the predetermined wading depth.

In embodiments, the wading detection means may be operable to determine vehicle speed or to receive a signal indicative of the vehicle speed. In such embodiments, a wading condition may correspond to a wading risk determined based on a detected or anticipated wading depth and a vehicle speed, for example to determine a situation in which the audible output means is likely to be exposed to excessive water. Other situations are also envisaged and would be appreciated by the skilled person.

According to another aspect of the invention, there is provided a vehicle comprising an active noise system and a wading detection means. The active noise system may be configured or operable to deactivate, in use, audible output means thereof on or after a wading condition, e.g. a predetermined wading depth, is detected or anticipated by the wading detection means. The active noise system may, but need not, be as described above. The vehicle may comprise an internal combustion engine and/or an electric machine. The vehicle may comprise a hybrid electric vehicle.

According to yet another aspect of the invention, there is provided a method of protecting an active noise system for a vehicle. The method may comprise detecting or anticipating a wading condition and deactivating an audible output means of the active noise system on or after the wading condition is detected or anticipated.

The method may comprise detecting the end of a wading condition and, optionally, reactivating the audible output means, for example on or after the end of the wading condition is detected. The audible output means may be reactivated after a predetermined period of time, e.g. after the end of a wading condition is detected.

The method may comprise detecting or anticipating a wading depth and, optionally, deactivating the audible output means if the detected or anticipated wading depth exceeds a predetermined wading depth. The method may comprise monitoring the wading depth, for example constantly and/or continuously or intermittently.

The method may comprise reactivating the audible output means if the detected or anticipated or monitored wading depth is or drops below the predetermined wading depth.

The output means may comprise one or more, e.g. two or more, such as a plurality of acoustic output devices. The method may comprise deactivating two or more or each acoustic output device independently, e.g. on or after detection or anticipation of a respective wading depth.

The method may comprise deactivating a first acoustic output device and/or a second acoustic output device. In embodiments, the method comprises deactivating the first acoustic output device if the detected or anticipated or monitored wading depth exceeds a first predetermined wading depth. Additionally or alternatively, the method may comprise deactivating the second acoustic output device if the detected or anticipated or monitored wading depth exceeds a second wading depth.

The method may comprise reactivating the first acoustic output device and/or the second acoustic output device. In embodiments, the method comprises reactivating the first acoustic output device if the detected or anticipated or monitored wading depth is or drops below the first predetermined wading depth. Additionally or alternatively, the method may comprise reactivating the second acoustic output device if the detected or anticipated or monitored wading depth drops below the second predetermined wading depth.

In some embodiments, two or more or each of the respective wading depths, e.g. the first and second wading depths, are different, while in other embodiments they are the same.

According to a further aspect of the invention, there is provided a computer program element comprising computer readable program code or code means for causing a processor to execute a procedure to implement the aforementioned method. A yet further aspect of the invention provides the computer program element embodied on a computer readable medium.

According to a still further aspect of the invention, there is provided a computer readable medium having a program stored thereon, where the program is arranged to make a computer execute a procedure to implement the aforementioned method.

According to a still further aspect of the invention, there is provided a control means or control system or controller comprising the aforementioned computer program element or computer readable medium.

The control means or control system or controller may incorporate one or more control features of one or more or each of the active noise system, the wading detection system and/or the vehicle engine control system.

According to yet another aspect of the invention, there is provided a controller with an input means for receiving a signal from a wading detection means and a processor configured to deactivate, in use, audible output means of an active noise system on or after receipt of a signal by the input means corresponding to the detection or anticipation of a wading condition by the wading detection means.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described, by way of example only, with reference to the accompanying drawings, in which.

DETAILED DESCRIPTION

Figure 1:
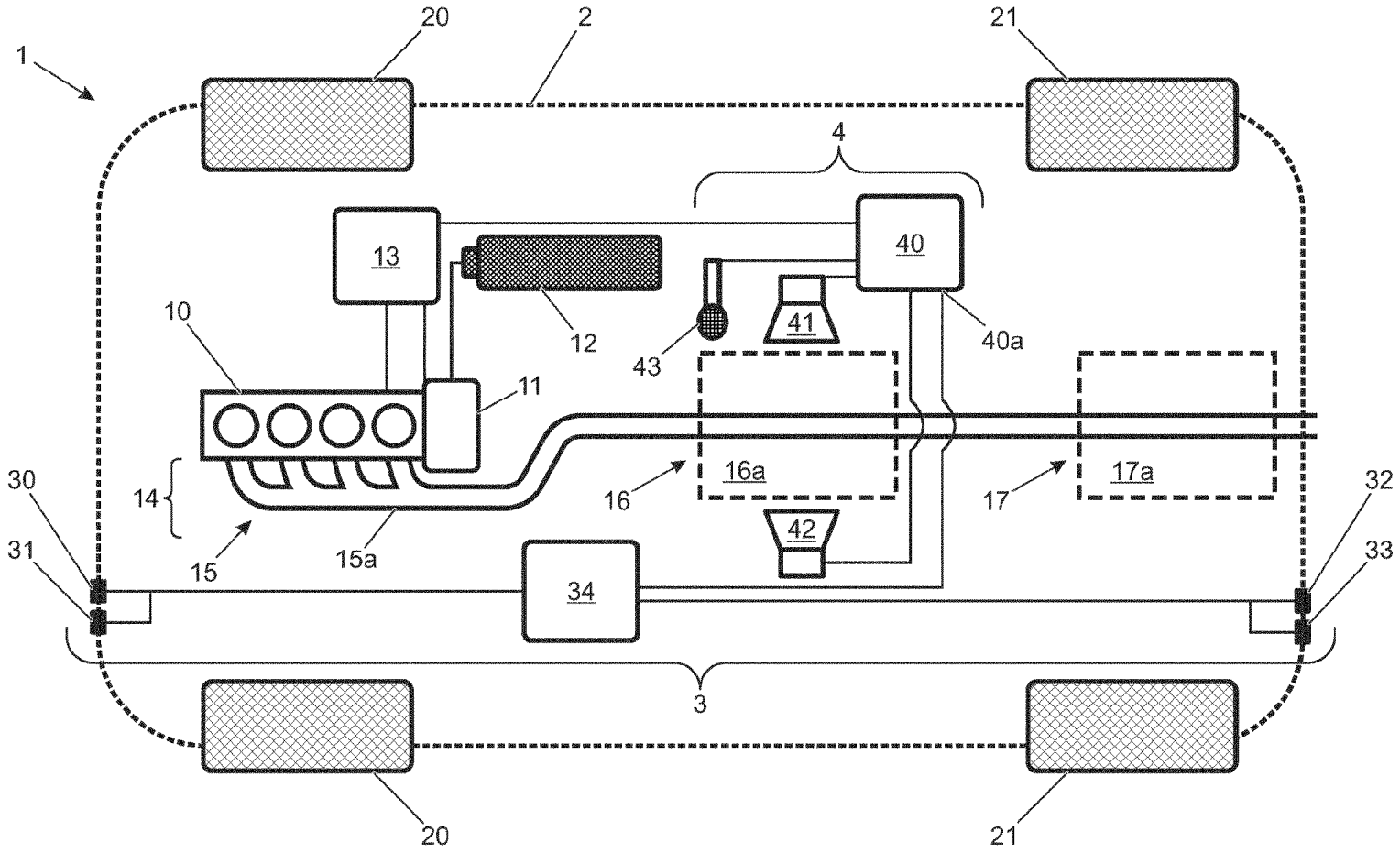
FIG. 1 is a schematic representation of a vehicle incorporating an active noise system and a wading detection system in accordance with an embodiment of the invention.
Figure 2:
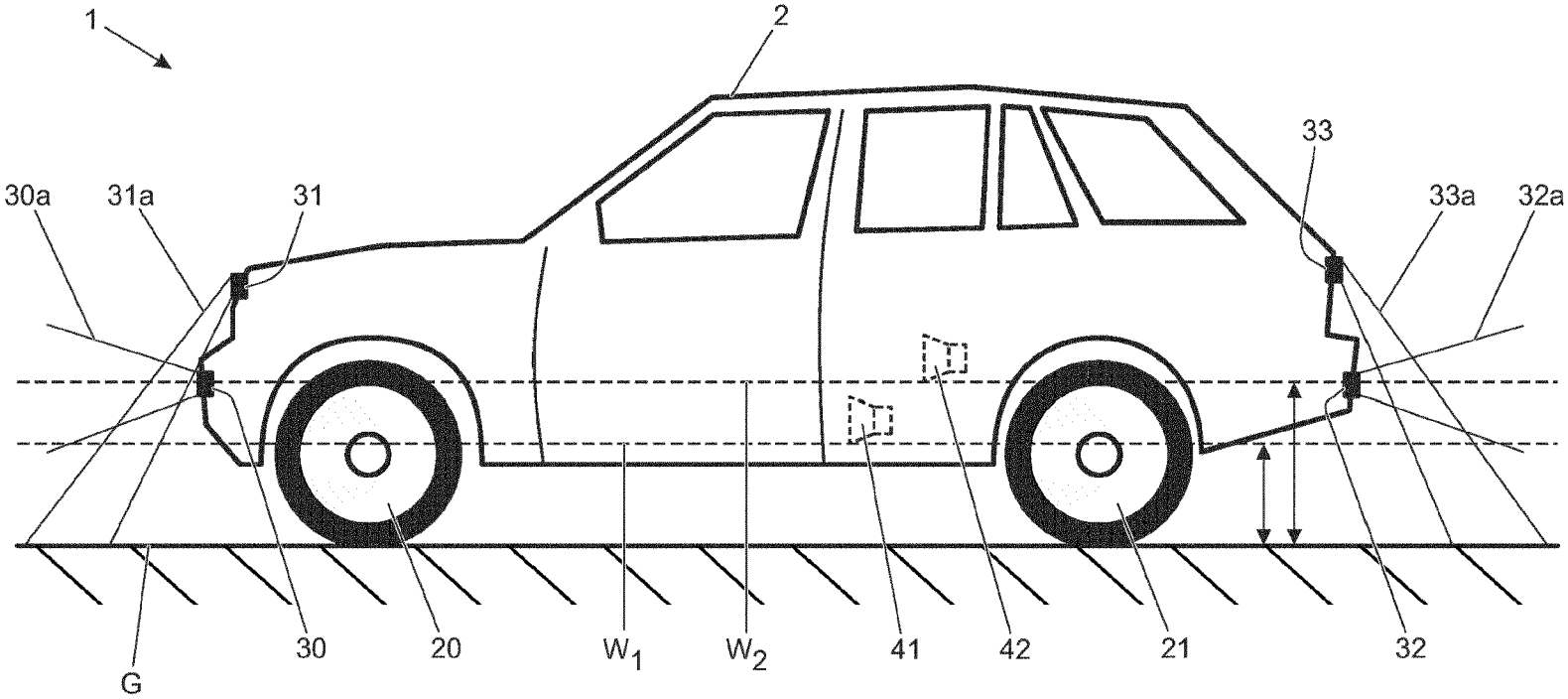
FIG. 2 is a side view of the vehicle of FIG. 1 illustrating two predetermined wading depths.

A vehicle in accordance with an embodiment of the invention is described herein with reference to the accompanying FIGS. 1 and 2.

With reference to FIG. 1, there is provided a series hybrid-electric vehicle 1 that includes an internal combustion engine (ICE) 10, an electric machine (EM) 11, which is integrated as a motor/generator a second electric machine and associated driveline (not shown) are used to drive the wheels in this embodiment. The vehicle 1 also includes a body 2 with front wheels 20 and rear wheels 21, a wading detection system 3 and an active noise system 4.

The ICE 10 and EM 11 are arranged to be able to provide electrical energy to charge the battery 12. The battery 12 is able to then power the second motor to deliver torque individually to a driveline (not shown) which ultimately provides torque to the rear wheels 21 of the vehicle 1.

In other vehicles having a parallel hybrid configuration (not shown), the ICE 10 has a crankshaft drivable connection to an EM 11 input, the output of the EM 11 drivingly connects to the input of a transmission and driveline (not shown). In this way a parallel architecture is able to drive mechanical power from the ICE 10, through the transmission and driveline (not shown) to drive the vehicle and it is optional for the EM 11 to either add motive torque to the connected transmission or to take torque from the transmission to regenerate electrical power back into the battery, as is known by persons skilled in the art of hybrid vehicles.

The inventive concept could also be used in conventional non hybrid vehicle architects where exhaust/vehicle noise modification is required.

The various states of use of the combination of the ICE 10, the EM 11 and the battery 12 are controlled by a hybrid controller 13 of the vehicle 1. The hybrid controller 13 may be part of a larger vehicle electronic control unit (ECU), or may be a separate or otherwise integrated ECU, module, or other electronic or computer circuit or program.

Such hybrid electric vehicles, and various alternative embodiments, as well as their use and control systems, are known in the prior art and will not be described further herein.

In at least one drive mode, the vehicle may be provided with motive torque by the EM 11 whilst the ICE 10 is inactive. In at least one drive mode, the vehicle may be in motion whilst the ICE 10 is inactive and the EM 11 may not be supplying torque, or may indeed be supplying an effectively negative torque by acting as a generator.

The ICE 10 produces exhaust gases, which pass through an exhaust system 14 of the vehicle. The exhaust system 14 includes a front section 15 with an exhaust manifold 15*a*, a centre section 16 with a centre box 16*a* and a rear section 17 with a rear box 17*a*. The skilled person will be familiar with such exhaust systems, which will not be described further herein.

The wading detection system 3 includes ultrasonic sensors 30, 31, 32, 33 of the kind used for determining parking distances, which are all operatively connected to a wading detection controller 34. The sensors 30, 31, 32, 33 include lower and upper front sensors 30, 31 and lower and upper rear sensors 32, 33. The lower front sensor 30 is mounted in the front bumper ahead of the front wheels 20 and the upper front sensor 31 is mounted to the front of the vehicle 1 above the lower front sensor 30. Similarly, the lower rear sensor 32 is mounted to the rear bumper behind the rear wheels 21 and the upper rear sensor 33 is mounted to the rear of the vehicle 1 above the lower rear sensor 32.

As shown more clearly in FIG. 2, the lower front sensor 30 has an output cone 30*a* diverging from the sensor 30 in a forward horizontal direction with respect to the front of the vehicle 1. Similarly, the lower rear sensor 32 has an output cone 32*a* diverging from the sensor 32 in a rearward horizontal direction with respect to the rear of the vehicle 1. The upper front sensor 31 has an output cone 31*a* diverging from the sensor 31 in a forward, but downward direction with respect to the front of the vehicle 1. The upper rear sensor 33 also has an output cone 33*a* that diverges from the sensor 33 in a rearward, but downward direction with respect to the rear of the vehicle 1.

The lower sensors 30, 32 both transmit and receive ultrasonic signals to detect obstructions in the normal way, while the upper sensors 31, 33 both transmit and receive ultrasonic signals reflecting from the ground surface G. If immersed, the response of the sensors 30, 31, 32, 33 changes, thereby enabling their use to detect wading. Specifically, the response may for example exploit the different signal propagation speed for water and air, or the different diaphragm settling time for air and water immersion. The upper, downward facing sensors 31, 33 also receive ultrasonic signals reflected from the surface of water, and can thus be used to indicate a depth of water since the mounting location on the vehicle is known in relation to ground level, or can be interpolated from a suspension height sensor of a variable height suspension. In addition, these sensors 31, 33 allow detection for both forward and rearward vehicle motion, and can give an indication of inclination.

Other means of detecting wading and/or depth of wading may be used.

The vehicle 1 is also equipped with an active noise system 4 comprising a controller 40, speakers 41, 42 and a noise sensor 43. The controller 40 includes an input 40*a* that is connected to and receives signals from the wading detection controller 34 indicative of a measured wading depth. The speakers 41, 42 are located at different vertical positions as shown more clearly in FIG. 2. The noise sensor 43 is operable to detect and measure noise generated by the exhaust system 14 and provides a reading to the controller 40. The controller 40 is configured to generate a control signal to the speakers 41, 42 which may then act to modify the exhaust noise emitted from the vehicle 1. Such modification may correspond to a noise-cancelling of all or part of the noise, or may be an enhancement of all or part of the noise. Such systems when acting in this way are in general known to those skilled in the art.

In embodiments, the active noise system 4 may be used to alert pedestrians when the vehicle 1 is powered by the EM 11 with the ICE 10 inactive or when both the EM 11 and the ICE 10 are inactive, for example in a coasting situation. In such situations, the active noise system controller 40 receives a signal from the hybrid controller 13 indicating that the ICE 10 is inactive, but that the vehicle 1 is in motion. The active noise system controller 40 then outputs a control signal to the speakers 41, 42, causing them to emit a noise signal. This noise signal is largely similar to the noise that might be expected of an ICE 10. In embodiments, the proximity of at least one of the speakers 41, 42 to the centre exhaust box 16*a* causes the exhaust box 16*a* to reverberate and increase the intensity or alter the tone of the noise emitted by the speakers 41, 42. In embodiments, the noise emitted and/or thus created by the speakers 41, 42 themselves or in combination with the exhaust system 14 may be modulated so as to vary appropriately with the speed of the vehicle 1.

The active noise system 4 may additionally or alternatively be configured to enhance the noise produced by the exhaust system 14, for example where a sport mode is enabled and it is desirable to produce a predetermined noise profile. It is also envisaged that the active noise system 4 may be configured to suppress exhaust noise in order to provide a quiet 'luxury' driving experience for drivers or passengers.

In this embodiment, the wading detection system 3 is configured to detect a wading situation using the upper, downward facing sensors 31, 33. On detection of a wading situation, the wading detection controller 34 determines both the wading depth and the rate of change of the wading depth over time using the ultrasonic signals reflected from the surface of water and detected by the upper, downward facing sensors 31, 33. Based on these values, the wading detection controller 34 anticipates a first predetermined wading depth $W_1$ at which the water will come into contact with the lower speaker 41 and, in response thereto, the wading detection controller 34 sends a signal to the active noise system controller 40, which disables the lower speaker 41. If the wading depth increases, the lower sensors 30, 32 are submerged, providing a second indication, to be used in combination with the depth measured by the upper sensors 31, 33, that a second predetermined wading depth $W_2$ has been reached. The wading detection controller 34 then sends a signal to the active noise system controller 40, which disables the upper speaker 42.

Thus, the aforementioned risk of damage to the speakers 41, 42 that would otherwise result from their operation in water is prevented. Deactivation of the speakers 41, 42 may comprise electrically isolating the speakers 41, 42. Additionally or alternatively, deactivation of the speakers 41, 42 may simply involve the active noise system controller 40 operating on a condition of not supplying signals thereto.

When the vehicle 1 exits the body of water and the detected water level drops below the second predetermined wading depth $W_2$, the wading detection system 3 sends a further signal to the active noise system controller 40, which reactivates the upper speaker 42 after a predetermined period of time, five minutes in this embodiment. Similarly, when the detected water level drops below the first predetermined wading depth $W_1$, the wading detection system 3 sends a yet further signal to the active noise system controller 40, which reactivates the lower speaker 41 after a predetermined period of time, also five minutes in this embodiment. The purpose of the delay is to ensure that any water surrounding the speaker 42 has been drained off. It will be appreciated that five minutes is purely illustrative and that the actual delay may be more or less than this value. It is also envisaged that one or more other factors may be considered. For example, the speed of the vehicle 1 and measured wading depth may be used to determine a situation in which one or each speaker 41, 42 is likely to be exposed to excessive water, in which case reactivation may be delayed. Other situations are also envisaged and would be appreciated by the skilled person.

It will be appreciated that the speakers 41, 42 need not be located at different vertical heights. It is expressly envisaged that both speakers 41, 42 may be located at the same height, for example on opposite sides of the centre box 16*a* of the exhaust system 14. In such cases, there may only be a single predetermined wading depth $W_1$. Additionally or alternatively, the active noise system 4 may incorporate additional speakers and/or other audible devices, such as one or more audible alarms or sirens or horns or other such devices, which may be located at different positions. In such cases, there may be three or more predetermined wading depths. The speakers 41, 42 may be separate from the exhaust system 14 and/or may be mounted underbody in any suitable position where there is sufficient space. The speakers 41, 42 may act as a muffler and/or may be housed in an exhaust muffler.

Similarly, the wading detection system 3 may additionally or alternatively include sensors 30, 31, 32, 33 of a different design, for example one or more camera detectors or computer vision apparatus. In embodiments, the wading detection system 3 incorporates a geospatial positioning system and may also include a communication means for receiving information regarding water levels and/or precipitation levels associated with one or more geospatial locations. In such embodiments, the wading detection system 3 may incorporate one or more algorithms operable to anticipate a wading condition based at least in part on information received by the communication means.

The invention claimed is:

1. An active noise system for external use on a vehicle, the system comprising:

audible output means mounted to an underside of the vehicle, or comprised in, on or connected, in use, to an exhaust system of the vehicle;

wading detection means configured to detect a wading depth and to detect a wading condition corresponding to a detected wading depth that exceeds a predetermined wading depth and an end of the wading condition corresponding to the detected wading depth becoming less than the predetermined wading depth;

an input means for receiving one or more signals from the wading detection means; and a processor operatively connected to the audible output means and to the input means, wherein the processor is configured to deactivate, in use, the audible output means on or after receipt of the one or more signals from the wading detection means corresponding to the wading detection means detecting or anticipating the wading condition.

2. A system according to claim 1, wherein the processor is configured to reactivate, in use, the audible output means on or after receipt of one or more signals from the wading detection means corresponding to detection, by the wading detection means, of an end of the wading condition.

3. A system according to claim 2, wherein the processor is configured to reactivate, in use, the audible output means after a predetermined period of time after detection by the wading detection means of the end of the wading condition.

4. A system according to claim 1, wherein the audible output means comprises one or more speakers.

5. A system according to claim 4, wherein the audible output means comprises two or more speakers, wherein the processor is configured to deactivate, in use, a first one of the speakers on or after detection or anticipation by the wading detection means of a first wading depth and to deactivate a second one of the speakers on or after detection or anticipation by the wading detection means of a second wading depth.

6. A system according to claim 5, wherein the processor is configured to reactivate, in use, the first speaker on or after detection by the wading detection means of a depth less than the first wading depth and to reactivate the second speaker on or after detection by the wading detection means of a depth less than the second wading depth.

7. A system according to claim 1, wherein the wading detection means is operatively connected to the input means.

8. A system according to claim 1, wherein the wading detection means comprises at least:

a sensor responsive to contact with water or a sensor operable to sense water by at least one of transmission and reflection of a waveform or a camera detector or a computer vision apparatus or a geospatial positioning means.

9. A vehicle comprising an externally mounted active noise system according to claim 1, and wherein the wading detection means is operatively connected to the input means of the active noise system.

10. A method of protecting an active noise system comprising audible output means, wherein the audible output means is mounted to an underside of a vehicle, or comprised in, on or connected, in use, to an exhaust system of the vehicle, the method comprising:

detecting a wading depth;

detecting or anticipating a wading condition corresponding to the detected wading depth exceeding a predetermined wading depth;

deactivating the audible output means of the active noise system when or after the wading condition is detected or anticipated;

detecting an end of the wading condition corresponding to the detected wading depth becoming less than the predetermined wading depth; and reactivating the audible output means when or after the end of the wading condition is detected.

11. A method according to claim 10, further comprising reactivating the audible output means after a predetermined period of time after the end of the wading condition is detected.

12. A method according to claim 10, wherein the detecting or anticipating the wading condition comprises detecting or anticipating a wading depth and wherein the deactivating the audible output means occurs if the detected or anticipated wading depth exceeds a predetermined wading depth.

13. A method according to claim 12, comprising monitoring the wading depth continuously or intermittently.

14. A method according to claim 12, comprising monitoring the wading depth intermittently.

15. A non-transitory computer readable medium including program code, when executed by a processor, causing the processor to perform the method of claim 10.

16. A controller comprising the computer readable medium of claim 15.

17. A non-transitory computer readable medium having a program stored thereon, where the program, when executed by a computer, causes the computer to perform the method of claim 10.

18. An active noise system for external use on a vehicle, the system comprising:

audible output means mounted to an underside of the vehicle, or comprised in, on or connected, in use, to an exhaust system of the vehicle, the audible output means comprising two or more speakers;

wading detection means configured to detect a wading depth and to detect a wading condition corresponding to a detected wading depth that exceeds a predetermined wading depth and an end of the wading condition corresponding to the detected wading depth becoming less than the predetermined wading depth;

an input means for receiving one or more signals from the wading detection means; and a processor operatively connected to the audible output means and to the input means, wherein the processor is configured to deactivate, in use, the audible output means on or after receipt of the one or more signals from the wading detection means corresponding to the wading detection means detecting or anticipating the wading condition, wherein the processor is configured to deactivate, in use, a first one of the speakers on or after detection or anticipation by the wading detection means of a first wading depth and to deactivate a second one of the speakers on or after detection or anticipation by the wading detection means of a second wading depth.

19. A system according to claim 18, wherein the processor is configured to reactivate, in use, the first speaker on or after detection by the wading detection means of a depth less than the first wading depth and to reactivate the second speaker on or after detection by the wading detection means of a depth less than the second wading depth.

* * * * *